US009059540B2

(12) United States Patent
Menez et al.

(10) Patent No.: US 9,059,540 B2
(45) Date of Patent: Jun. 16, 2015

(54) ELECTRICAL CONNECTOR ASSEMBLY, AND CONNECTOR FOR SUCH ASSEMBLY

(75) Inventors: Frederic Menez, Hermeray (FR); Claude Casses, Clevilliers (FR); Paulo De Matos, Saint Luperce (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 15 days.

(21) Appl. No.: 14/115,640

(22) PCT Filed: May 16, 2012

(86) PCT No.: PCT/EP2012/059205

§ 371 (c)(1),
(2), (4) Date: Nov. 5, 2013

(87) PCT Pub. No.: WO2012/156486

PCT Pub. Date: Nov. 22, 2012

(65) Prior Publication Data

US 2014/0106591 A1 Apr. 17, 2014

(30) Foreign Application Priority Data

May 18, 2011 (WO) ..... PCT/IB2011/001461

(51) Int. Cl.

| | |
|---|---|
| ***H01R 13/518*** | (2006.01) |
| ***H01R 13/639*** | (2006.01) |
| ***H01R 13/627*** | (2006.01) |
| ***H01R 13/629*** | (2006.01) |
| ***H01R 13/641*** | (2006.01) |

(52) U.S. Cl.

CPC ..... *H01R 13/6397* (2013.01); *H01R 13/6272* (2013.01); *H01R 13/62927* (2013.01); *H01R 13/639* (2013.01); *H01R 13/641* (2013.01)

(58) Field of Classification Search

CPC ..... H01R 13/62927; H01R 13/62933; H01R 13/6397; H01R 13/6272; H01R 13/4361

USPC ..... 439/304, 352, 578, 489, 157, 638, 752, 439/345, 353, 357

See application file for complete search history.

(56) References Cited

U.S. PATENT DOCUMENTS

| | | | | |
|---|---|---|---|---|
| 5,775,957 | A * | 7/1998 | Fink et al. | 439/752 |
| 6,210,186 | B1 * | 4/2001 | Fink et al. | 439/157 |
| 6,488,524 | B2 * | 12/2002 | Endo | 439/353 |
| 6,491,542 | B1 | 12/2002 | Zerebilov | |
| 6,537,099 | B2 * | 3/2003 | Herlinger et al. | 439/352 |

(Continued)

FOREIGN PATENT DOCUMENTS

EP 2120297 A1 11/2009

OTHER PUBLICATIONS

International Search Report dated Jul. 26, 2012.

*Primary Examiner* — Amy Cohen Johnson
*Assistant Examiner* — Matthew T Dzierzynski
(74) *Attorney, Agent, or Firm* — Robert J. Myers

(57) ABSTRACT

The electrical connector assembly includes a first connector having a first housing, a second connector having a second housing, and a cover movably mounted on the housing. The housing of the second connector is movably mounted on the housing of the first connector. A lock that may be actuated is movably mounted on one of the housings. In the initial position of the cover, the cover covers or shields the lock. In the final position of the cover, the cover does not shield the lock.

27 Claims, 4 Drawing Sheets

(56) References Cited

U.S. PATENT DOCUMENTS 6,846,195 B2 1/2005 Annequin
8,597,062 B2 * 12/2013 Casses et al. ..... 439/686
2003/0040210 A1 2/2003 Herlinger et al.
2009/0286425 A1 11/2009 Wadoux
2010/0111597 A1 5/2010 Kodama et al.
2012/0064752 A1 * 3/2012 Jeon et al. ..... 439/345

* cited by examiner

ELECTRICAL CONNECTOR ASSEMBLY, AND CONNECTOR FOR SUCH ASSEMBLY

CROSS-REFERENCE TO RELATED APPLICATION

This application is a national stage application under 35 U.S.C. §371 of PCT Application Number PCT/EP2012/059205 having an international filing date of May 16, 2012, which designated the United States, which PCT application claimed the benefit of PCT Application Number PCT/IB2011/001461, filed May 18, 2011, the entire disclosure of each of which are hereby incorporated herein by reference.

TECHNICAL FIELD OF THE INVENTION

The instant invention relates to electrical connector assemblies, and connectors for such assemblies.

BACKGROUND OF THE INVENTION

An electrical connector assembly usually comprises a first connector and a second complementary connector. In assembled condition, electrical power or signals are transmitted between two appliances through the connector assembly. Hence, the two connectors need to be firmly locked to one another.

One common way of locking together two connectors is by snap-fitting one connector housing to another one. Hence, locking is performed as a consequence of the movement of the two connectors toward one another.

Another way is by providing a locking piece which is rigid and movable on one of the housings, for example under a separate actuation by the user. In such case, it is important to make sure that the lock is actuated after the connectors have been assembled. It is also important that the lock be not actuated before the connectors have been assembled, because such actuation may prevent connection of the connectors, and/or damage the lock during this connection.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

It is provided an electrical connector assembly according to claim 1.

In the initial position of the cover, the cover prevents movement of the lock between its lock and release conditions, for instance the cover may mask access to the lock.

In the final position of the cover, the cover allows hand actuation of the lock.

With these features, one reduces the risk of the lock being actuated before the connectors are properly assembled.

In some embodiments, one might also use one or more of the features as defined in the claims.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

On the different Figures, the same reference signs designate like or similar elements.

DETAILED DESCRIPTION OF THE INVENTION

Figure 1:
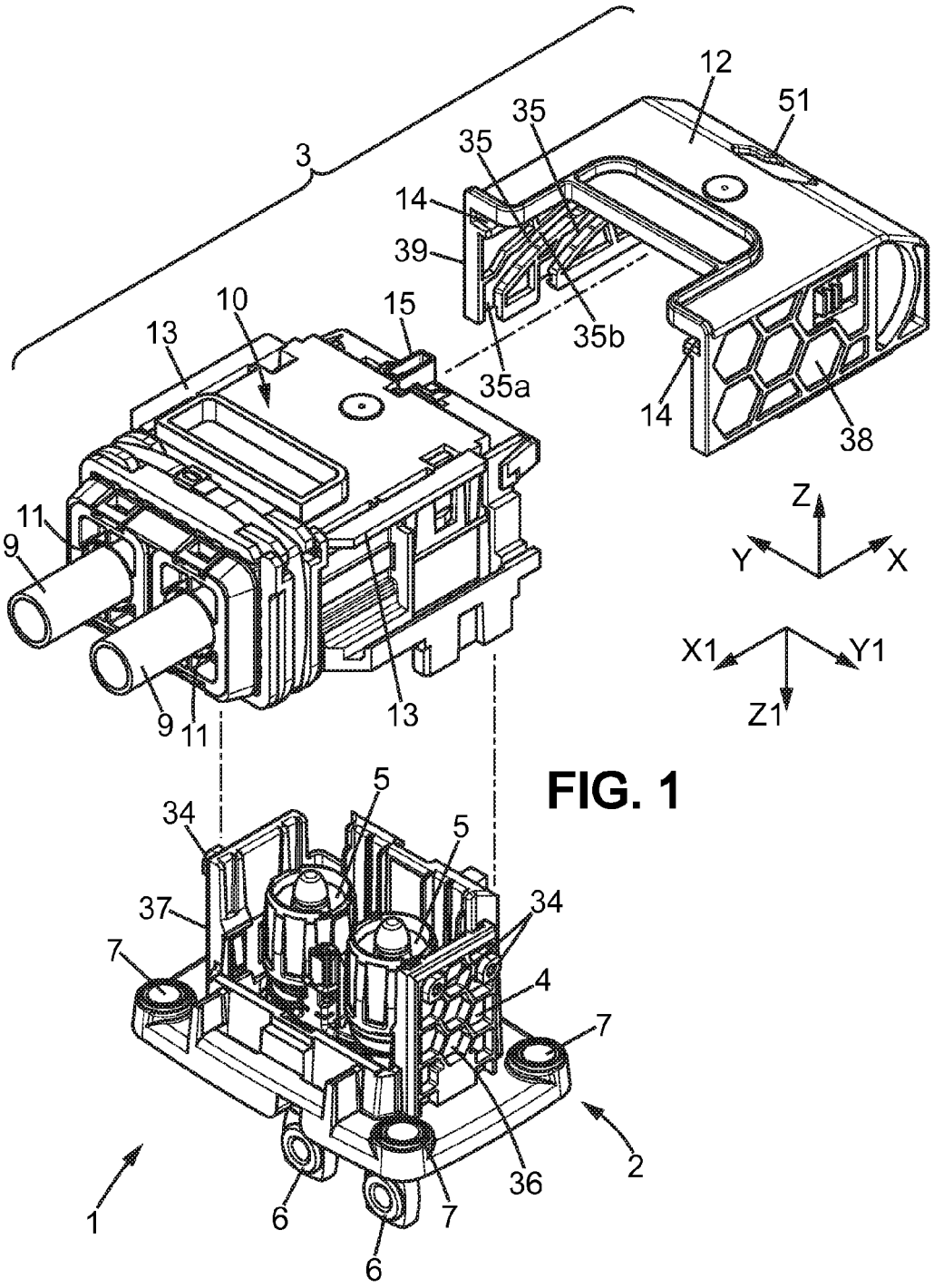
FIG. 1 is an exploded perspective view of an electrical connector assembly according to an embodiment of the invention.

FIG. 1 schematically shows in perspective an example of an electrical connector assembly 1 according to the invention. The electrical connector assembly 1 comprises a first connector 2 and a second connector 3, which are to be mated/unmated along a mating direction Z. Z is the direction along which the unmating of the two connectors takes place. The first connector 2 comprises a first housing 4 which defines a plurality of pathways 5 for respective electrical contacts 6. The first housing 4 is made of an electrically insulating material, so as to insulate the contacts 6 from one another. The contacts 6 extend for example in the respective passageways along direction Z. The first housing 4 may further comprise fixation parts 7 such as through holes adapted to fasten the first connector 2 to an electrical appliance (not shown).

According to the embodiment described here, the second connector 3 is a right-angled connector. However, the invention could be implemented alternatively for straight connectors. In the right-angled second connector 3, the electrical parts are right angled. They are for example provided as right-angled contact elements 8 (see FIG. 3), each corresponding to a respective contact 6 of the first connector 2, and attached to a respective wire 9. The wires 9 enter the second connector 3 along the direction X, and the contact elements 8 have a first contact portion extending along the direction X, and electrically connected to the wire 9, and a second contact portion extending in the direction opposite to the direction Z.

The second connector 3 comprises an electrically insulating second housing 10 having a body 100 defining a plurality of pathways 11 each corresponding to a respective contact.

The second connector 3 further comprises a cover 12 which is slidable with respect to the second housing 10 between an initial and a final position. In the present example, the cover 12 is provided to slide along direction X and is provided on the side of the second housing 10 which is opposite to the side which receives the wires 9. The cover 12 is able to slide with respect to the second housing 10 from its initial position to its final position along the direction opposite to the direction X. Sliding is provided by complementary shapes of the second housing 10 and the cover 12, such as for example, lateral wings 13 of the second housing 10 which are guided in a longitudinal groove 14 of the cover 12 (FIG. 1).

The cover 12 is provided with a through opening 51, and an abutment tab 52 projects inward at this opening 51.

The second connector 3 further bears a lock 15 which is part of a locking system of the connector assembly 1. The lock 15 is an integral (rigid) part which is movable in respect to the second housing 10 between a lock and a release conditions. In the present example, the lock 15 is provided to slide with respect to the second housing 10 along the direction Y from its lock condition to its release condition. It is for example also provided on the side of the second housing 10 which is opposite to the wires 9.

In the initial position of the cover 12 with respect to the second housing 10, the cover 12 covers or shields the lock 15, so that the lock 15 is not accessible from outside. In particular, a user with normally-sized fingers cannot access or actuate the lock 15 in the initial position of the cover 12.

Figure 2:
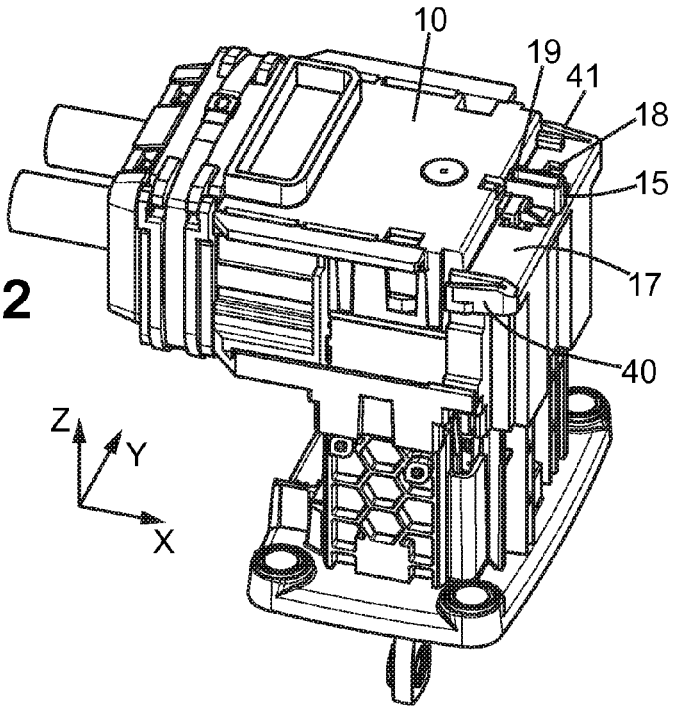
FIG. 2 is a partial view according to another perspective of the connector assembly of FIG. 1 in an unassembled condition.
Figure 4:
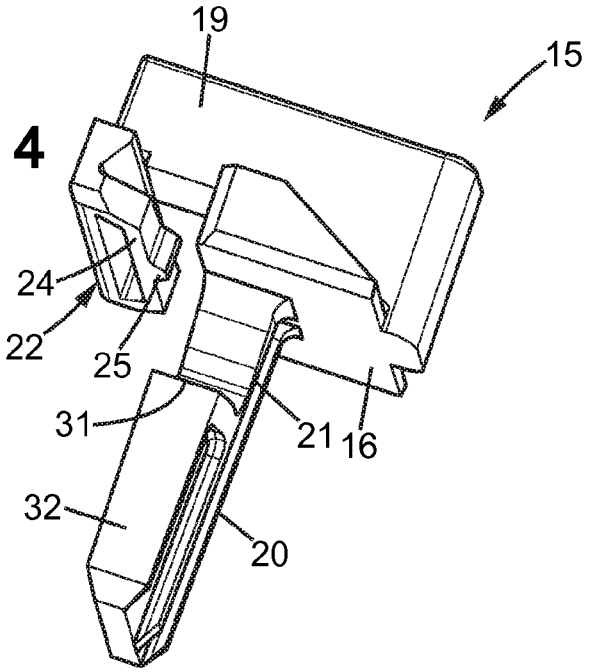
FIG. 4 is a perspective view of a lock.

As can be seen in particular on FIG. 2, where the cover 12 is not shown, and FIG. 4, the lock 15 has a sliding surface 16 which is flat in order to slide on a complementary flat surface 17 of the second housing 10. The lock 15 is provided through a through groove 18 of the second housing 10 with an actuation portion 19 protruding above the flat surface 17. The lock 15 further includes a lock portion 20 protruding below the flat surface 17 and a neck portion 21 linking the actuation portion 19 to the lock portion 20. The neck portion 21 is designed to be guided inside the groove 18.

The lock 15 further comprises mounting means 22 which is used to cooperate with complementary mounting means 23 of the second housing 10 to retain the lock 15 in each of its lock and release conditions with respect to the second housing 10. Hence, mounting means 22 comprises a flexible arm 24 carrying a protrusion 25 which is insertable in a corresponding receiving groove 26 of the second housing 10. The receiving groove 26 is provided with two protrusions 27 and 28 which are spaced apart along the Y direction and define respectively the lock and the release conditions of the lock 15.

Figure 6:
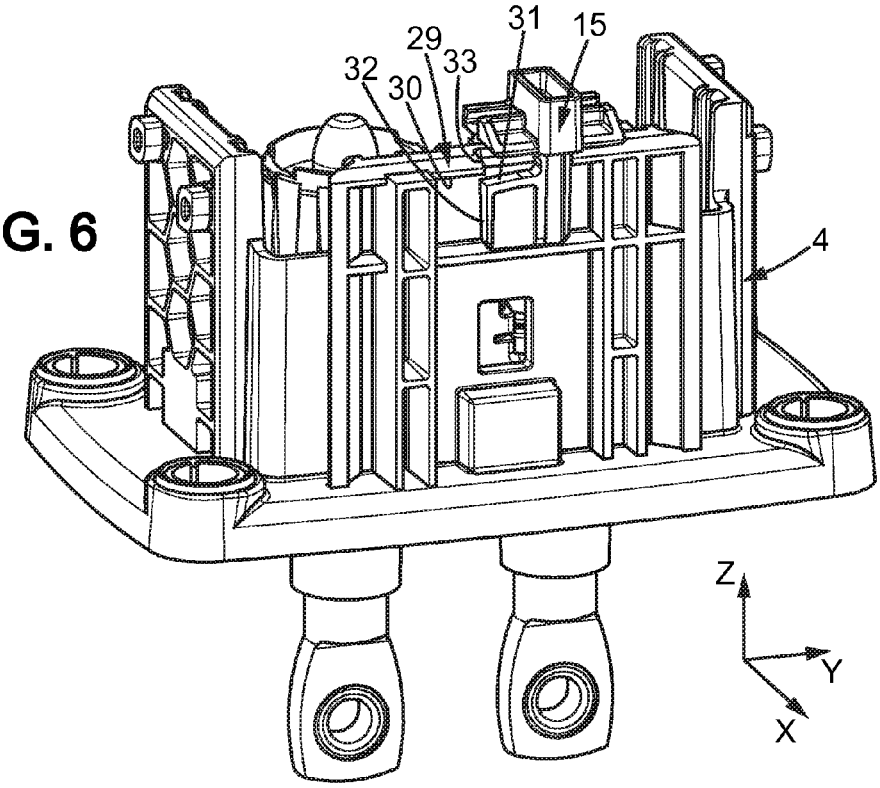
FIG. 6 is a perspective of the assembly of the lock in its release condition and of the first connector in the assembled condition of the connector housings.

As can be seen in particular on FIG. 6, the locking system comprises, in addition to the lock 15, a locking part 29 provided on the first housing 4 of the first connector 2. The locking part 29 comprises a first locking surface 30 which is complementary with a second locking surface 31 of the lock 15 so as to prevent any relative movement of the lock 15 and of the first housing 4 along direction Z when the first and second surfaces 30, 31 face each other. In particular, the second locking surface 31 of the lock 15 is provided facing direction Z whereas the first locking surface 30 of the first housing 4 is provided facing opposite direction Z.

Further, the lock 15 comprises a first abutment surface 32, and the first housing 4 comprises a complementary second abutment surface 33 which will be described in more details below. The first abutment surface 32 is provided as a surface of the lock portion 20, which faces opposite the direction Y, whereas the second abutment surface 33 is provided as a surface of the first housing 4 which faces direction Y.

Turning back to FIG. 1, the connector assembly 1 further comprises a mate assisting system. The mate assisting system is adapted to cause a relative mating movement of the first housing 4 and the second housing 10 relative to one another as the cover 12 moves with respect to the second housing 10 of the second connector 3 from its initial to its final positions.

As a purely illustrative example, the mate assistance system can be provided as pins 34 of the first housing 4 of the first connector 2 and complementary grooves 35 of the cover 12. For example, the first housing 4 has two lateral walls 36, 37 which extend in the X-Z plane, and are spaced apart along the direction Y with the pins 34 provided on an outer surface of such walls. Two pins 34 are provided per wall. Similarly, the cover 12 has two lateral walls 38, 39 corresponding respectively to the two lateral walls 36, 37 and which each comprise two grooves, each pair of grooves 35 correspond to a pair of pins 34. Each groove 35 comprises a first groove portion **35*a* which extends along the direction Z, and a second slanted groove portion 35*b*** which is slanted in the X-Z plane. Providing four parallel pin/groove systems enable to guide the movement along a given axis.

The second connector 3 further comprises a locking system adapted, in its active condition, to lock the cover 12 and the second housing 10 in the initial position of the cover 12. In particular, it prevents movement of the cover 12 along the X direction with respect to the second housing 10. This lock 15 can for example be provided as a flexible first lance 40 provided on a first side of the second housing 10 and which cooperates with a stop 42 of the cover 12. In the initial position of the cover 12 with respect to the second housing 10, the end **40*a* of the first lance 40, cooperates with the stop 42 so as to prevent movement of the cover 12 along direction X. Movement of the cover 12 along the direction opposite the direction X is normally hindered by friction the first lance 40, on a first stop 44 provided facing the external face of the first lance 40**.

Figure 3:
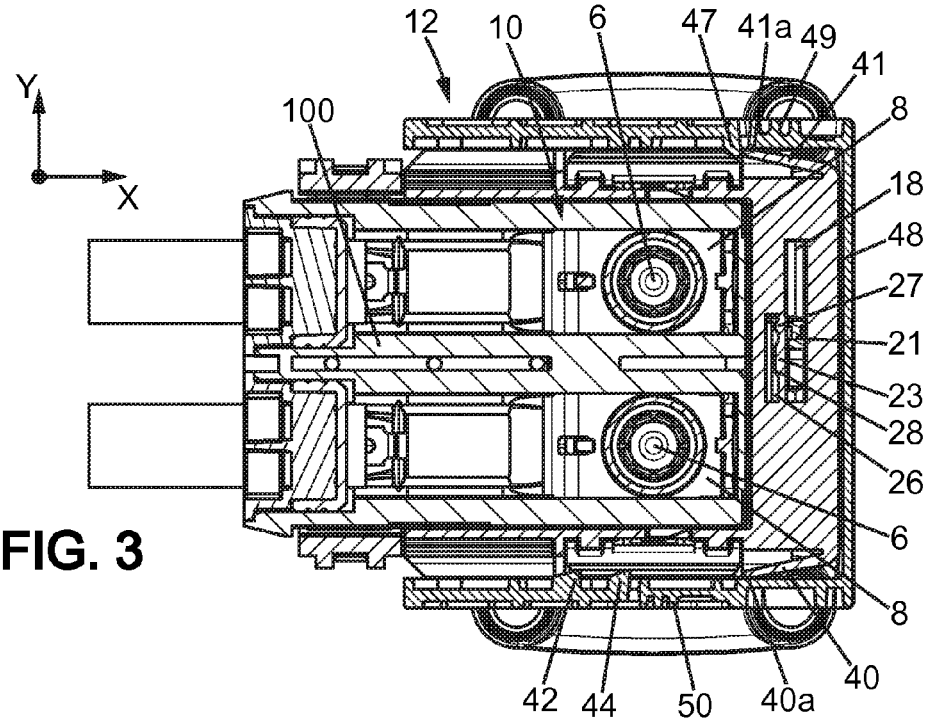
FIG. 3 is a sectional split view along line III-III of FIG. 7 of the connector assembly in assembled condition.

As shown on FIG. 3, in the final position of the cover 12, the cover 12 is locked to the second housing 10 by a locking system which comprises the end **41*a* of a second lance 41 parallel to the first lance 40 on the other side of the second housing 10, and cooperating with a second stop 47 provided in the cover 12. Movement in the direction opposite is prevented by abutment of the internal face of the cover 12 on the corresponding face 48 of the second housing 10**.

An actuation system 49 is provided so as to disengage the second lance 41 from the second stop 47. The actuation system 49 is for example provided as a flexible button provided on the cover 12 and facing the second lance 41 in the final position of the cover 12 and which, under actuation of a user, will flex, thereby causing bending of the second lance 41 out of engagement with the second stop 47.

In addition, an intermediate lock and an intermediate stop can be provided, so as to lock the cover 12 on the second housing 10 in an intermediate position upon movement of the cover 12 from its final position to its initial position. This intermediate lock is for example provided by the first lance 40 cooperating with the first stop 44 of the cover 12. The actuation is provided by an intermediate actuation system 50 which is for example similar to the actuation system 49, comprising a flexible button which, in the intermediate position of the cover 12 will flex, thereby causing bending of the first lance 40 out of engagement with the first stop 44. The actuation systems 49, 50 can be offset with respect to one another along direction X so as to ensure actuation of the one after the other. The first and second lances 40, 41 and the stops 42 to 47 may also be provided along different heights along direction Z as shown. The internal face of the intermediate first stop 44 can also be provided slanted, so as to not hinder the movement of the cover 12 with respect to the second housing 10 in the direction opposite the direction X, when setting the cover 12 in place from its initial position to its final position. This also applies to the internal surface of the stop 42, so as to enable to assemble the cover 12 to the second housing 10.

The system further comprise a so-called "connection position assurance" (CPA) system which comprises a moving part which can be moved from a first position to a second position when the first and second connectors are assembled, and, cannot be moved from its first to its second position before the two connectors 10 are assembled.

Such "CPA" enables a visual indication that the connectors are properly assembled; if the connectors are not properly assembled, the operator will know it, since he will not be able to displace the part from its first to its second positions.

In the present case, the CPA element is provided by the lock 15 itself. Operation of the system will now be disclosed. Initially, one provides, on one side, the first connector 2, and in the other side, the second connector 3. The second connector 3 is provided with the lock 15 in its release condition and the cover 12 in its initial position. In this position, the lock 15 and in particular its actuation portion 19, is totally covered by the cover 12, and therefore is not accessible by an operator with normal-sized fingers.

Upon mating, the second connector 3 will be moved along the direction opposite to direction Z with respect to the first connector 2 to mate the connectors to one another. In fact, the second connector 3 is placed on the first connector 2 so that the pins 34 are located in the vertical first and second groove portions 35*a* 35*b* of the respective grooves of the cover 12. Then, the cover 12 is moved from its initial position to its final position along the direction opposite to X. Cooperation of the mate assisting system, i.e. the pins 34 sliding in the grooves 35 will cause, upon movement of the cover 12 with respect to the second housing 10 along the direction opposite X, the respective movement of the first and second housings 4, 10 toward one another.

Figure 5:
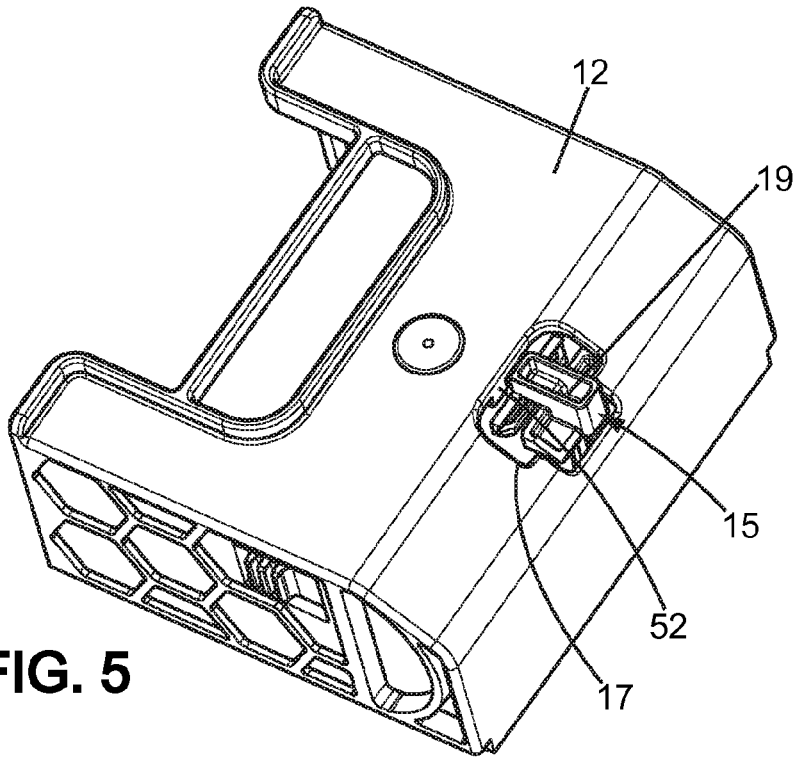
FIG. 5 is a perspective view of the assembly of the lock and the cover in the final position of the cover.
Figure 7:
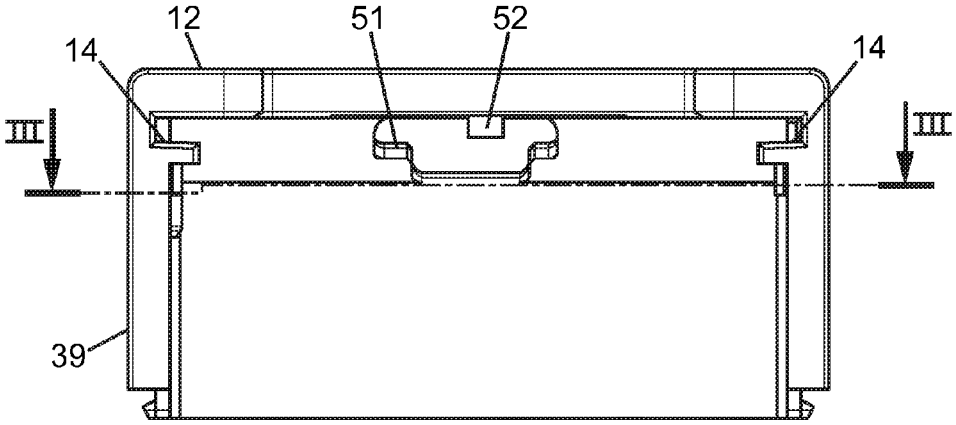
FIG. 7 is a front view of the cover.

In the final position of the cover 12, as shown on FIG. 5, the actuation portion 19 of the lock 15 will protrude through the opening 51 of the cover 12 (see also the opening 51 on FIG. 7). Hence, only in this position, can the lock 15 be hand-actuated to move from its release position to its lock position. At this stage, the cover 12 is locked on the second housing 10 by cooperation of the second lance 41 with the second stop 47 as shown on FIG. 3.

In this final position, the tab 52 of the cover 12 is then clear of the lock 15, hence not preventing any movement of the lock 15 (cf. FIG. 5).

However, all the way of travel of the cover 12 from an intermediate position to this final position, the tab 52 faces a corresponding part of the lock 15, thereby preventing the lock 15 from moving toward its lock position.

Hence, between the initial and the intermediate position, the cover 12 shields the lock 15, thereby preventing its actuation. Between the intermediate and the final positions, where the lock 15 is partly accessible through the opening 51, its movement is prevented by the tab 52. Depending on the embodiments, the tab 52 could prevent movement of the lock 15 on part or all along the path of the cover 12.

Also in this final position, the operator can actuate the actuation portion 19 of the lock 15 to have the lock 15 moved from its release condition to its lock condition, along the direction opposite to Y. The release condition of the lock 15 is shown on FIG. 6. In its lock condition, the second locking surface 31 faces the first locking surface 30 of the first housing 4 of the first connector 2, so that movement of the second connector 3 with respect to the first connector 2 along direction Z is prevented. The two connectors 4, 10 are locked to one another.

It should be mentioned that if the first and second housings 4, 10 are not perfectly assembled before operation of the lock 15, the lock 15 can also act as a supplementary mate assisting device, by cooperation of the slanted second locking surface 31 with the cooperating first locking surface 30, thereby imparting further relative movement toward one another along direction Z of the two connectors 10.

However, if the operator tries to actuate the lock 15 before the first and second housings 4, 10 are sufficiently assembled to one another, abutment of the first and second abutment surfaces 32, 33 of, respectively, the lock 15 and the first housing 4, will prevent movement of the lock 15 from its release condition to its lock condition. In such case, the lock 15 acts as CPA element, because it is prevented from moving, thereby indicating that the two connectors 10 are not properly assembled.

It should be noted that in the locked condition of the lock 15, the protrusion 25 of the flexible arm 24 will cooperate with the protrusion 28 of the second housing 10 to retain the lock 15 with respect to the second housing 10 in the lock condition of the lock 15. Thus, movement of the lock 15 with respect to the second housing 10 from its release with lock condition imparts deformation of the flexible arm 24 of the lock 15.

In order to disassemble the connector assembly 1, the operator will first actuate the lock 15 through the opening 51 from its lock condition to its release condition.

Then, the operator will actuate the actuation system 49 so as to move the second lance 41 out of engagement with the second stop 47, and move the cover 12 along direction X with respect to the second housing 10. Cooperation of the pins 34 and the grooves 35 will also cause partly a movement of the second housing 10 of the second connector 3 along direction Z with respect to that of the first connector 2. The cover 12 will reach a stage where the first lance 40 cooperates with the first stop 44 in an intermediate position. The operator will then actuate the actuation system 50 so as to deflect the first lance 40 out of engagement with the first stop 44 and continue the movement of the cover 12 along the direction X.

Although the invention was described with the lock 15 provided on the second housing 10 of the second connector 3, it may also alternatively be provided on the first housing 4.

The axis system $X_1$; $Y_1$; $Z_1$ is opposed to the axis system X, Y, Z.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

The invention claimed is:

1. An electrical connector assembly, comprising:

a first connector having a first housing;

a second connector having a second housing, and a cover movably mounted on said second housing between an initial and a final position, the second housing-being movably mounted on the first housing between an unassembled condition and an assembled condition; and an actuable lock movably mounted on one of said first and second housings, said lock being movable, under actuation, when the first and second housings are in-the assembled condition, between a release condition where it does not maintain said first and second housings relative to one another and a lock condition where it maintains the first and second housings to one another, wherein, in an initial position of the cover, the cover prevents movement of the lock between the lock condition and the release condition, wherein, in the final position of the cover, the cover allows hand actuation of the lock, wherein the lock is slidably mounted on the second housing, wherein the lock comprises a first abutment portion, wherein the first housing comprises a second abutment portion, and wherein the first abutment portion and the second abutment portion cooperate to prevent the lock from moving from its release to the lock condition when the first and second housings are in an intermediate relative position, intermediate between the unassembled condition and the assembled condition.

2. The electrical connector assembly according to claim 1, wherein the cover and the first housing have corresponding features which cooperate with one another when the cover is moved with respect to the second housing from the initial position to the final position, to cause relative movement of the first and second housings from the unassembled condition to the assembled condition.

3. The electrical connector assembly according to claim 1, wherein the first and second housings are movable with respect to one another along a vertical direction, and wherein the cover is movable with respect to the second housing along a first horizontal direction.

4. The electrical connector assembly according to claim 1, wherein the cover is movable with respect to the second housing along a first horizontal direction, and wherein the lock is movable with respect to the second housing along a second horizontal direction which is normal to the first horizontal direction.

5. The electrical connector assembly according to claim 1, wherein the second housing comprises a body adapted to receive electrical wires.

6. The electrical connector assembly according to claim 1, wherein, the cover shields the lock in the initial position of the cover, thereby preventing actuation of the lock, wherein the cover does not shield the lock in the final position of the cover.

7. The electrical connector assembly according to claim 1, wherein the cover has an abutment part, and wherein, at least between an intermediate position of the cover and the final position, wherein the intermediate position is intermediate between the initial and final positions of the cover, the abutment part faces a complementary part of the lock, thereby preventing movement of the lock between the lock condition and the release condition and wherein, in the final position of the cover, the abutment part is away from the complementary part of the lock.

8. The electrical connector assembly according to claim 1, wherein a locking system is provided, said locking system having an active condition where it maintains the cover on said second housing in the initial position.

9. The electrical connector assembly according to claim 1, wherein the cover defines a hole, and wherein an actuation portion of the lock projects through the hole in the final position of the cover.

10. An electrical connector assembly, comprising:

a first connector having a first housing;

a second connector having a second housing, and a cover movably mounted on said second housing between an initial and a final position, the second housing-being movably mounted on the first housing between an unassembled condition and an assembled condition; and an actuable lock movably mounted on one of said first and second housings, said lock being movable, under actuation, when the first and second housings are in-the assembled condition, between a release condition where it does not maintain said first and second housings relative to one another and a lock condition where it maintains the first and second housings to one another, wherein, in an initial position of the cover, the cover prevents movement of the lock between the lock condition and the release condition, wherein, in the final position of the cover, the cover allows hand actuation of the lock, and wherein a locking system is provided, said locking system having an active condition where it maintains the cover on said second housing in an intermediate position intermediate between the initial and final positions, said locking system also having an inactive condition where it allows movement of the cover with respect to the second housing, and wherein the cover comprises an actuator adapted to place said locking system in the inactive condition.

11. The electrical connector assembly according to claim 10, wherein the cover and the first housing have corresponding features which cooperate with one another when the cover is moved with respect to the second housing from the initial position to the final position, to cause relative movement of the first and second housings from the unassembled condition to the assembled condition.

12. The electrical connector assembly according to claim 10, wherein the first and second housings are movable with respect to one another along a vertical direction, and wherein the cover is movable with respect to the second housing along a first horizontal direction.

13. The electrical connector assembly according to claim 10, wherein the cover is movable with respect to the second housing along a first horizontal direction, and wherein the lock is movable with respect to the second housing along a second horizontal direction which is normal to the first horizontal direction.

14. The electrical connector assembly according to claim 10, wherein the second housing comprises a body adapted to receive electrical wires.

15. The electrical connector assembly according to claim 10, wherein, the cover shields the lock in the initial position of the cover, thereby preventing actuation of the lock, wherein the cover does not shield the lock in the final position of the cover.

16. The electrical connector assembly according to claim 10, wherein the cover has an abutment part, and wherein, at least between an intermediate position of the cover and the final position, wherein the intermediate position is intermediate between the initial and final positions of the cover, the abutment part faces a complementary part of the lock, thereby preventing movement of the lock between the lock condition and the release condition and wherein, in the final position of the cover, the abutment part is away from the complementary part of the lock.

17. The electrical connector assembly according to claim 10, wherein a locking system is provided, said locking system having an active condition where it maintains the cover on said second housing in the initial position.

18. The electrical connector assembly according to claim 10, wherein the cover defines a hole, and wherein an actuation portion of the lock projects through the hole in the final position of the cover.

19. An electrical connector assembly, comprising:

a first connector having a first housing;

a second connector having a second housing, and a cover movably mounted on said second housing between an initial and a final position, the second housing-being movably mounted on the first housing between an unassembled condition and an assembled condition; and an actuable lock movably mounted on one of said first and second housings, said lock being movable, under actuation, when the first and second housings are in-the assembled condition, between a release condition where it does not maintain said first and second housings relative to one another and a lock condition where it maintains the first and second housings to one another, wherein, in an initial position of the cover, the cover prevents movement of the lock between the lock condition and the release condition, wherein, in the final position of the cover, the cover allows hand actuation of the lock, wherein the lock is slidably mounted on the second housing, wherein the lock and the first housing comprise cooperating slanted portions and wherein the cooperating slanted portions cause relative movement the first and second housings to the assembled condition when the first and second housings are in an intermediate relative position, intermediate between the unassembled condition and the assembled condition, upon movement of the lock from its release to the lock condition.

20. The electrical connector assembly according to claim 19, wherein the cover and the first housing have corresponding features which cooperate with one another when the cover is moved with respect to the second housing from the initial position to the final position, to cause relative movement of the first and second housings from the unassembled condition to the assembled condition.

21. The electrical connector assembly according to claim 19, wherein the first and second housings are movable with respect to one another along a vertical direction, and wherein the cover is movable with respect to the second housing along a first horizontal direction.

22. The electrical connector assembly according to claim 19, wherein the cover is movable with respect to the second housing along a first horizontal direction, and wherein the lock is movable with respect to the second housing along a second horizontal direction which is normal to the first horizontal direction.

23. The electrical connector assembly according to claim 19, wherein the second housing comprises a body adapted to receive electrical wires.

24. The electrical connector assembly according to claim 19, wherein, the cover shields the lock in the initial position of the cover, thereby preventing actuation of the lock, wherein the cover does not shield the lock in the final position of the cover.

25. The electrical connector assembly according to claim 19, wherein the cover has an abutment part, and wherein, at least between an intermediate position of the cover and the final position, wherein the intermediate position is intermediate between the initial and final positions of the cover, the abutment part faces a complementary part of the lock, thereby preventing movement of the lock between the lock condition and the release condition and wherein, in the final position of the cover, the abutment part is away from the complementary part of the lock.

26. The electrical connector assembly according to claim 19, wherein a locking system is provided, said locking system having an active condition where it maintains the cover on said second housing in the initial position.

27. The electrical connector assembly according to claim 19, wherein the cover defines a hole, and wherein an actuation portion of the lock projects through the hole in the final position of the cover.

* * * * *